US009375652B2

(12) United States Patent
Willett

(10) Patent No.: US 9,375,652 B2
(45) Date of Patent: Jun. 28, 2016

(54) CONFETTI CANNON AND METHOD OF MANUFACTURING AND USE THEREOF

(71) Applicant: Michael Willett, Dacula, GA (US)

(72) Inventor: Michael Willett, Dacula, GA (US)

( * ) Notice: Subject to any disclaimer, the term of this patent is extended or adjusted under 35 U.S.C. 154(b) by 3 days.

(21) Appl. No.: 14/288,162

(22) Filed: May 27, 2014

(65) Prior Publication Data

US 2015/0111464 A1 Apr. 23, 2015

(51) Int. Cl.
*A63H 37/00* (2006.01)
*A01K 5/00* (2006.01)

(52) U.S. Cl.
CPC ..... *A63H 37/00* (2013.01)

(58) Field of Classification Search
CPC ..... A63H 17/00; A63H 17/008; A63H 37/00; A63H 33/00; A01K 5/00; A01K 5/0114
USPC ..... 446/475, 483, 491; 124/57, 74, 79
See application file for complete search history.

(56) References Cited

U.S. PATENT DOCUMENTS 5,149,290 A * 9/1992 Reveen ..... 446/475
5,529,527 A 6/1996 Watkins
5,734,968 A 3/1998 Lay
6,364,737 B1 4/2002 Sterr et al.
8,827,189 B2 * 9/2014 Vanagosoom ..... 239/587.2
8,951,094 B2 * 2/2015 Ropelewski ..... 446/475
2013/0109274 A1 5/2013 Ropelewski

FOREIGN PATENT DOCUMENTS

GB 2503244 6/2012

OTHER PUBLICATIONS

The perfect CO2 continuous flow confetti cannon. http://www.atlspecialfx.com/collections/confetti-blasters/products/ideal-confetti-cannon-continuous-flow.
6.2 Zigmont Magic FX. http://www.effectspecialist.com/confetti.htm.

* cited by examiner

*Primary Examiner* — Kien Nguyen
(74) *Attorney, Agent, or Firm* — Benjamin A. Balser; Next IP Law Group

(57) ABSTRACT

A confetti cannon includes a one-piece housing. The one-piece housing has a confetti hopper, a launch tube, and a valve housing. The valve housing has an inlet connected to an internal valve. Whereby, the confetti hopper, the launch tube, and the valve housing are integrally formed to create the one-piece housing. The internal valve can be an electric solenoid valve for controlling the confetti cannon remotely.

19 Claims, 7 Drawing Sheets

CONFETTI CANNON AND METHOD OF MANUFACTURING AND USE THEREOF

TECHNICAL FIELD

The present disclosure is generally related to special effects systems and, more particularly, is related to devices for launching confetti, streamers, rose pedals, tickets, money, and the like into the air, also known as confetti cannons.

BACKGROUND

Confetti, also known as confetti streamers, is often used at the beginning or during spectator events and/or celebrations, or other desired locations, events, the like, etc. The confetti may be dropped from an elevated position or shot, blasted or burst out of a confetti cannon.

Bursts of confetti, streamers, or other similar materials like rose pedals, tickets, money, and the like, shot out of confetti cannons connected to compressed gas sources have long been used at shows, parties, circus acts and other events so as to produce displays of sound, color and motion. However, such cannons have been large or bulky and made of two or more parts or pieces that need to be attached or assembled together. For example, current confetti cannons have a hopper that needs to be mounted to the cannon or launch tube, which may also has to have a valve hooked up to it for regulating the compressed gas. As such, these cannons are difficult to transport, time consuming to setup and/or tear down, and limited to wear they can be placed, positioned and/or mounted. In addition, the current confetti cannons are often times rather large or bulky.

Current confetti cannons typically have a manual valve, like a ball valve, that is connected to a pressurized $CO_2$ tank for controlling the flow of gas into the cannon, i.e. the firing of the confetti. These manual valves require an operator to fire the confetti cannon by manually opening the valve in proximity to the device. This further limits the locations the confetti cannon can be placed or positioned and requires an operator to be present at the confetti cannon for firing. As such, it should be readily appreciated by those skilled in the special effects art that a confetti cannon that could be remotely fired would allow for easier operation and allow the confetti cannon device to be positioned in more optimal locations.

Therefore, it is readily apparent that there is a recognizable unmet need for a confetti cannon device that is compact, easy to transport, easy to setup and/or tear down, capable of being placed, positioned, and or mounted in more desired locations, and capable of being remotely fired.

The instant disclosure of confetti cannon and method of manufacture and use thereof may be provided to address at least some of the above mentioned problems.

SUMMARY

Briefly described, in a preferred embodiment, the present apparatus and method overcomes the above-mentioned disadvantages and meets the recognized need for such a device by providing a confetti cannon device for shooting, bursting or blasting confetti or confetti streamers that may be compact, may be easy to transport, may be easy to setup and/or tear down, and may be capable of being placed, positioned, and or mounted in numerous desired locations.

In select embodiments, the confetti cannon device includes a one-piece housing. The one-piece housing includes a confetti hopper, a launch tube, and a valve housing. The valve housing has an inlet connected to an internal valve. Whereby, the hopper, the launch tube, and the valve housing may be integrally formed to create the one-piece housing.

One feature may be that the internal valve can be an electric solenoid valve for controlling the confetti cannon remotely. The electric solenoid valve may be a normally closed valve that opens when powered and allows for remote firing of the confetti cannon via an activator, which can be a wired activator or a wireless activator.

Another feature may be that the wired activator may be a standard DMX controller, like a DMX512 dimmer pack, to signal the confetti cannon to blast.

Another feature may be a base plate for positioning the launch tube at various launch angles to the base plate, and/or for securing the confetti cannon in various locations or to various objects.

Another feature may be the inclusion of half moon slots for securing the confetti cannon and launch tube at the desire launch angle.

Another feature may be the inclusion of at least one hopper hole through the confetti hopper for safely preventing objects from being suctioned to the top of the confetti hopper.

Another feature may be the inclusion of a pipe nipple connected to and extending from the internal valve into the bottom of the launch tube for firing confetti inside the launch tube and creating a continuous vacuum from the confetti hopper to the launch tube.

Another feature may be that the confetti cannon may be operable as a confetti cannon by filling with confetti and connecting a pressurized CO2 tank to the internal valve, or it may be transformable into a CO2 cryogenic jet or fog machine by connecting a pressurized CO2 cryo tank to said inlet, or it may be transformable into a combined confetti cannon and CO2 cryogenic jet or fog machine by filling with confetti and connecting a pressurized CO2 cryo tank to the inlet.

In use, a method of remotely launching confetti into the air may be conducted utilizing the various embodiments of the confetti cannon as shown and described herein. The method may include the general steps of: providing the confetti cannon in any of the various embodiments shown and described herein including the internal valve being an electric solenoid valve for remote firing of the confetti cannon via an activator, connecting a pressurized CO2 tank to the internal valve, and firing the confetti cannon from a remote location via the activator.

One feature of the method of remotely launching confetti into the air may be when the activator is a standard DMX controller, like a DMX512 dimmer pack, the step of firing the confetti cannon from a remote location may include a step of remotely firing of the confetti cannon via the activator controlled by the DMX controller to signal the confetti cannon to blast.

Another feature of the method of remotely launching confetti into the air may be, when the provided confetti cannon may further comprise the base plate for positioning the launch tube at various launch angles, the method may further comprise the step of positioning the launch tube at a desired launch angle via the base plate.

Another feature of the method of remotely launching confetti into the air may be, when the base plate includes bolts for hingedly connecting the base plate to the confetti cannon wherein the bolts include wing nuts for tightening the bolts by hand, the step of positioning the launch tube at a desired launch angle via the base plate may include the step of tightening the wing nuts by hand at the desired launch angle.

Another feature of the method of remotely launching confetti into the air may be, when the base plate may be for securing the confetti cannon in various locations or to various objects, the method may further comprise the step of attaching the base plate in a desire location or to a desired object.

Another feature of the method of remotely launching confetti into the air may be, when the base plate may allow for wall or truss mounting using a standard clamp system, like a C or J type clamp system, the step of attaching the base plate in a desire location or to a desired object may include the step of mounting the base plate to a wall or truss using the clamp system.

BRIEF DESCRIPTION OF THE DRAWINGS

The present confetti cannon will be better understood by reading the Detailed Description with reference to the accompanying drawings, which are not necessarily drawn to scale, and in which like reference numerals denote similar structure and refer to like elements throughout, and in which.

DETAILED DESCRIPTION

Figure 1:
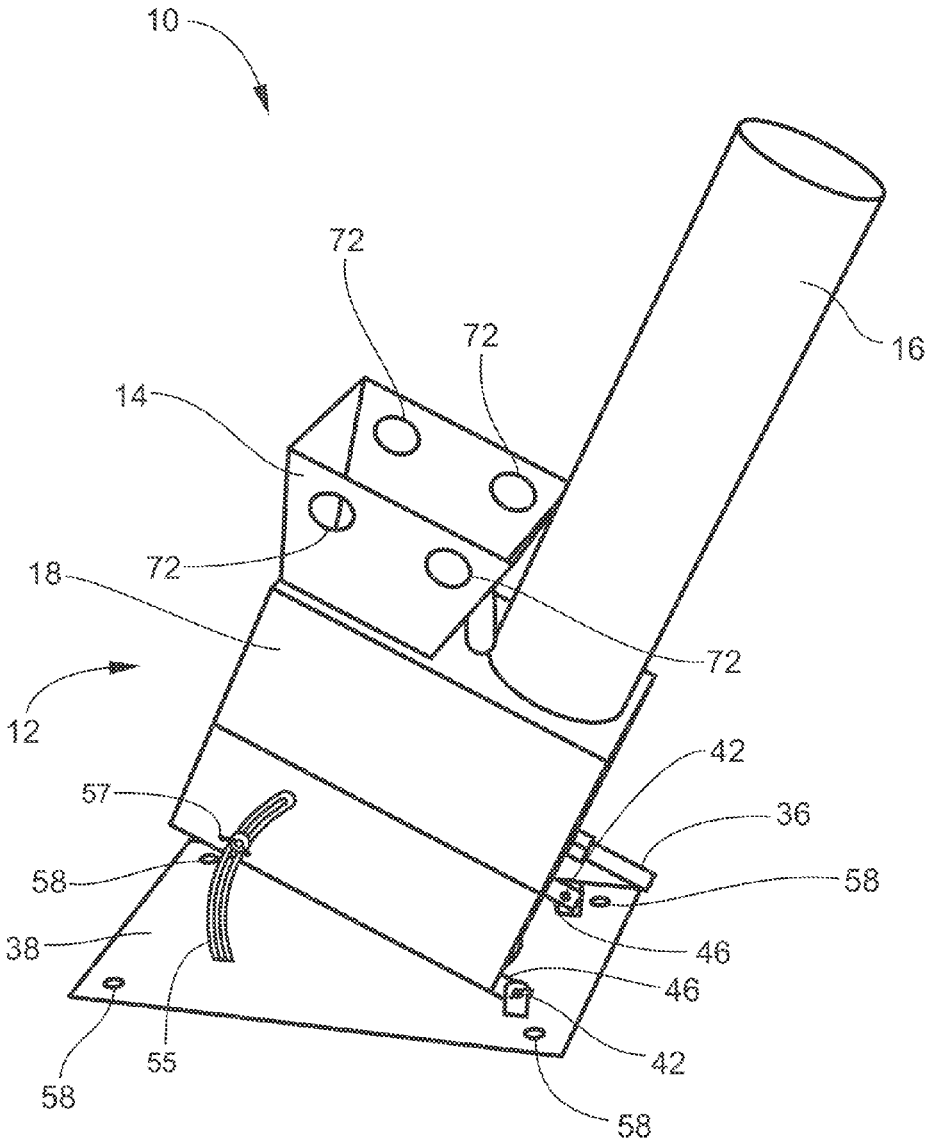
FIG. 1 is a perspective view of an example embodiment of a confetti cannon.
Figure 2:
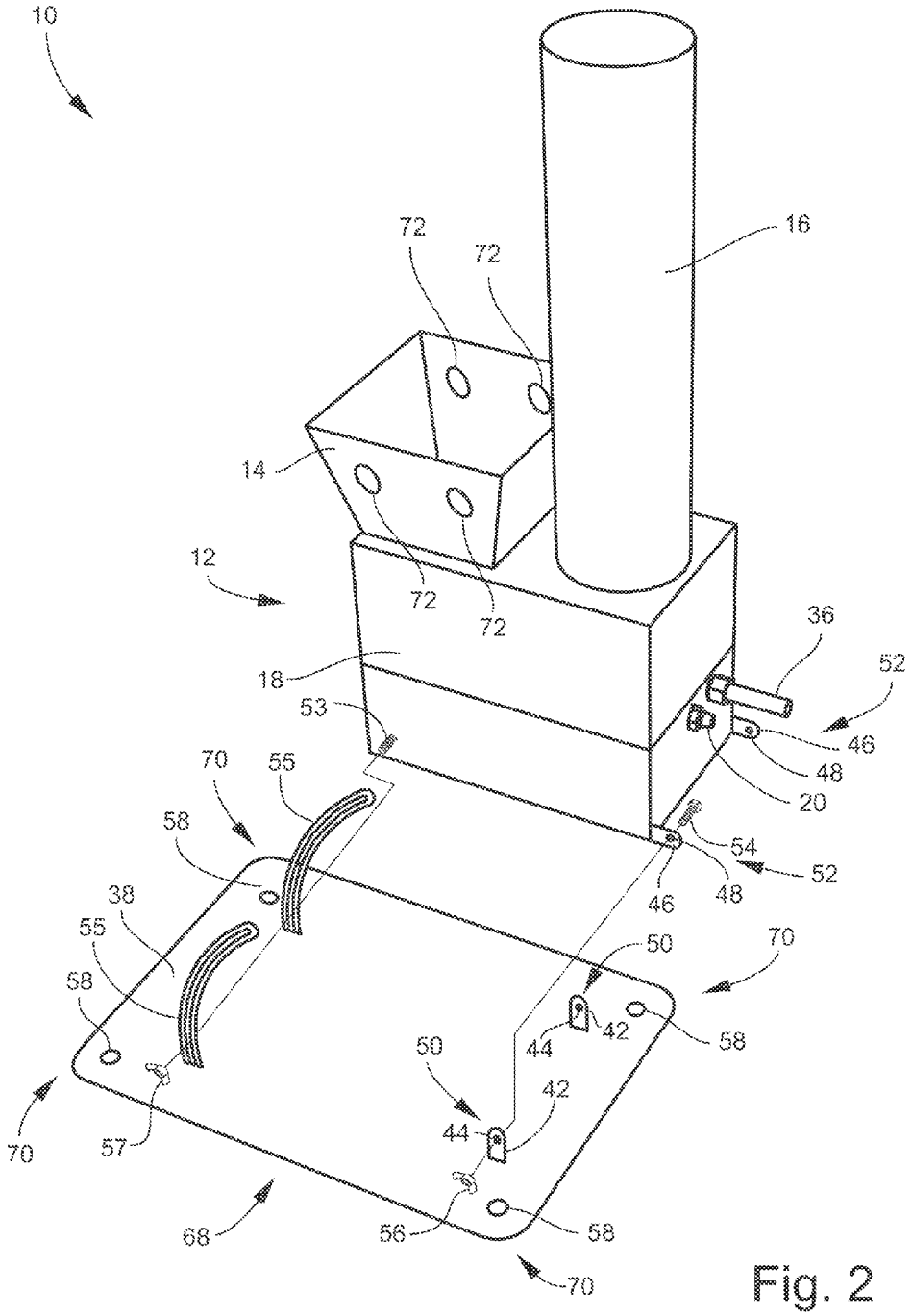
FIG. 2 is a partially disassembled perspective view of the confetti cannon device of FIG. 1.

In describing the exemplary embodiments of the present disclosure, as illustrated in FIGS. 1-9, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-8 by way of example, and not limitation, therein is illustrated example embodiments of confetti cannon 10 for firing, shooting, bursting, or blasting confetti. Confetti, as used herein, may refer to confetti, streamers, rose pedals, tickets, money, and/or or the like. As shown therein, confetti cannon 10 generally includes one-piece housing 12. One-piece housing 12 may include confetti hopper 14, launch tube 16 and valve housing 18. Valve housing 18 may include inlet 20 which may be connected to internal valve 22. Whereby, confetti hopper 14, launch tube 16, and valve housing 18 may be integrally formed to create one-piece housing 12.

Integrally formed one-piece housing 12, as used herein, refers to the one-piece housing 12 being manufactured or created as a single unit, requiring no assembly by the user. For example, one-piece housing 12 may not requires any assembly of confetti hopper 14 to launch tube 16, no assembly of launch tube 16 to valve housing 18, no assembly of confetti hopper 14 to valve housing 18, or combinations thereof. As such, integrally formed one-piece housing 12 may be created by any various integrally forming processes, including, but not limited to, any stamping processes, molding processes, welding processes, the like processes, or any combinations thereof for creating one-piece housing 12. One-piece housing 12 being integrally formed may allow for confetti cannon 10 to be compact, easy to transport, easy to setup and/or tear down, capable of being placed, positioned, and or mounted in more desired locations, the like, or any combinations thereof.

Figure 3:
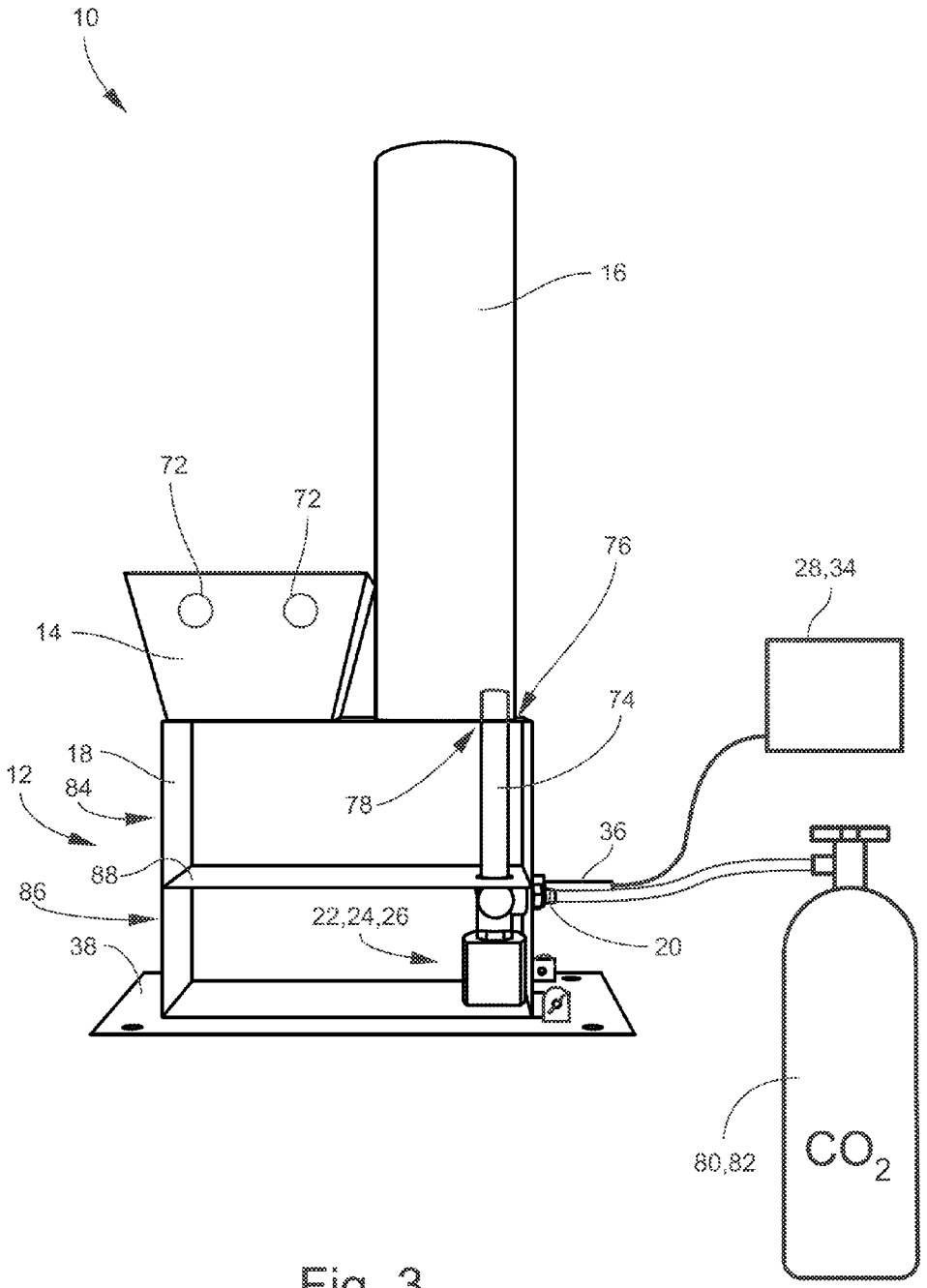
FIG. 3 is a cross-sectional system diagram of the confetti cannon device of FIG. 1.
Figure 4A:
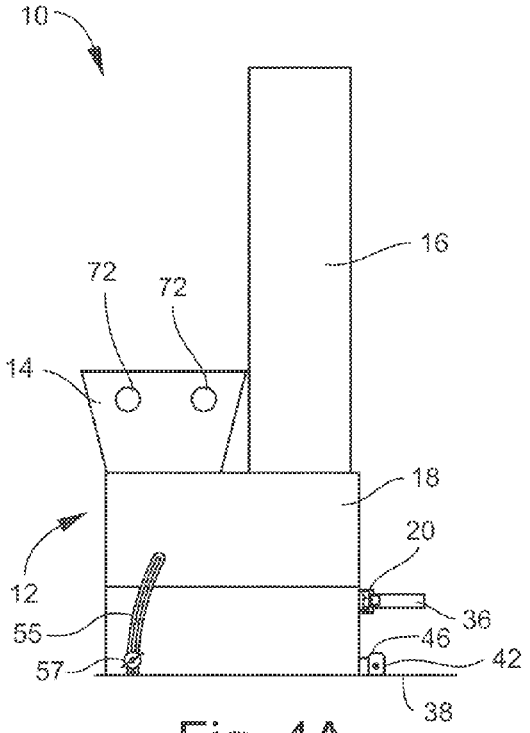
FIG. 4A is a front view of the confetti cannon device of FIG. 1 in a vertical firing position.
Figure 5:
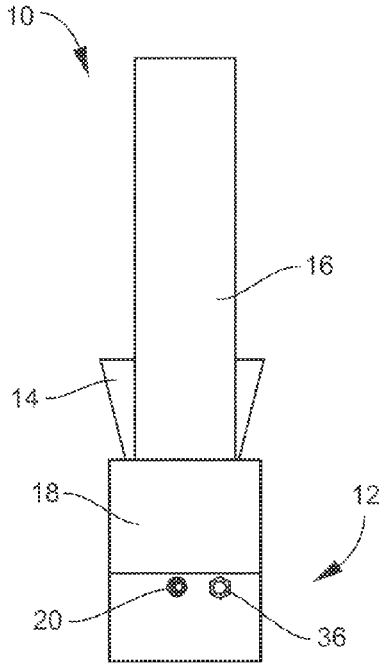
FIG. 5 is a side view of the confetti cannon device of FIG. 1.
Figure 4B:
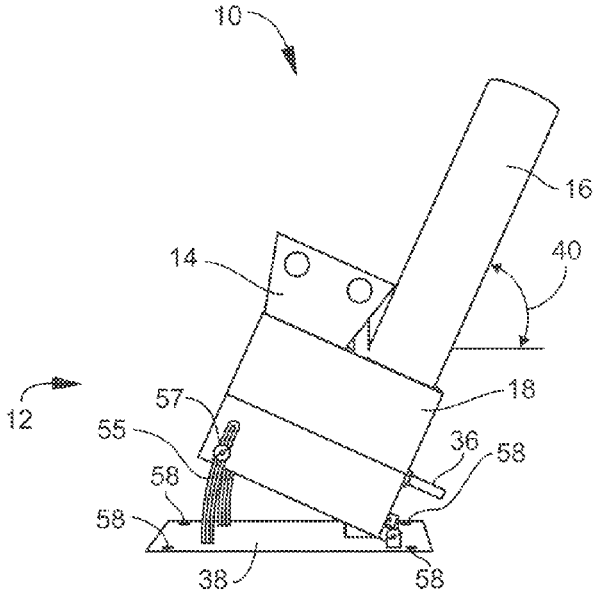
FIG. 4B is a front view of the confetti cannon device of FIG. 1 in an angled firing position.
Figure 6:
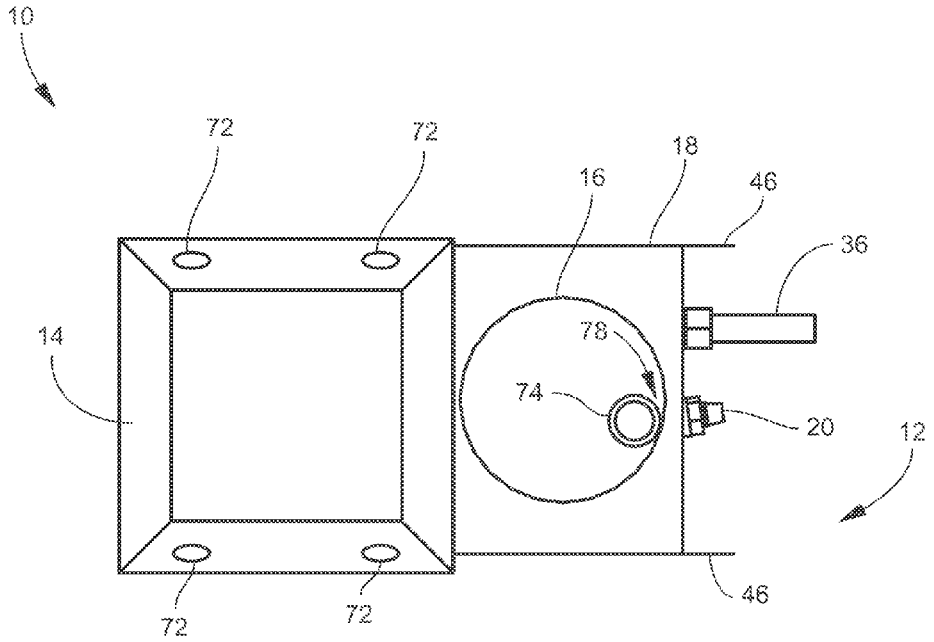
FIG. 6 is a top view of the confetti cannon device of FIG. 1.
Figure 7:
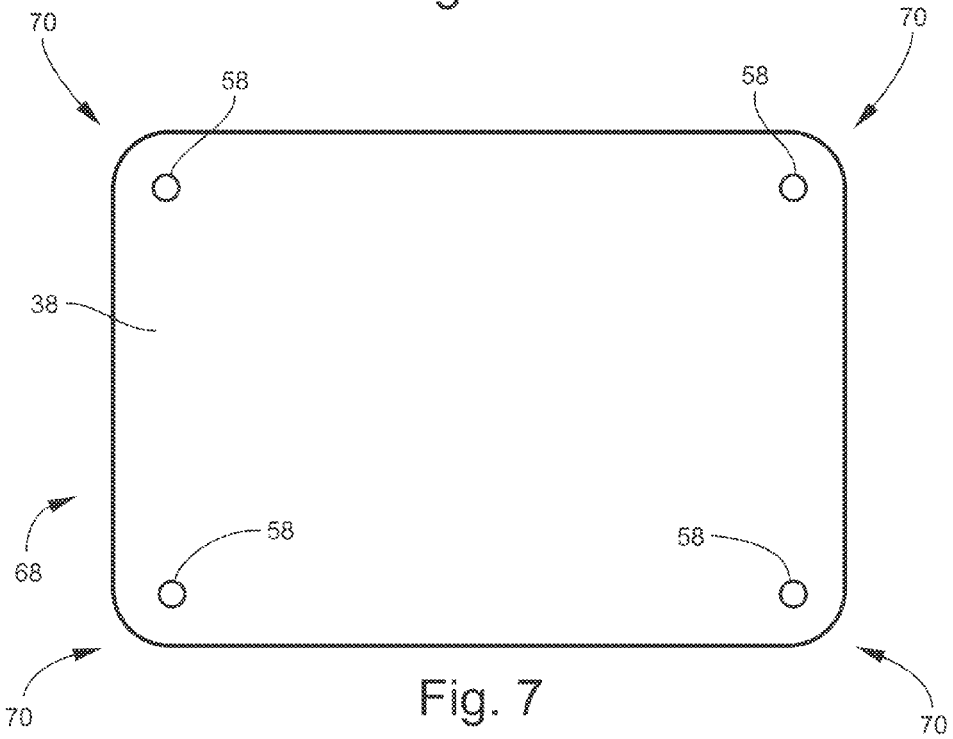
FIG. 7 is a bottom view of the confetti cannon device of FIG. 1.
Figure 8:
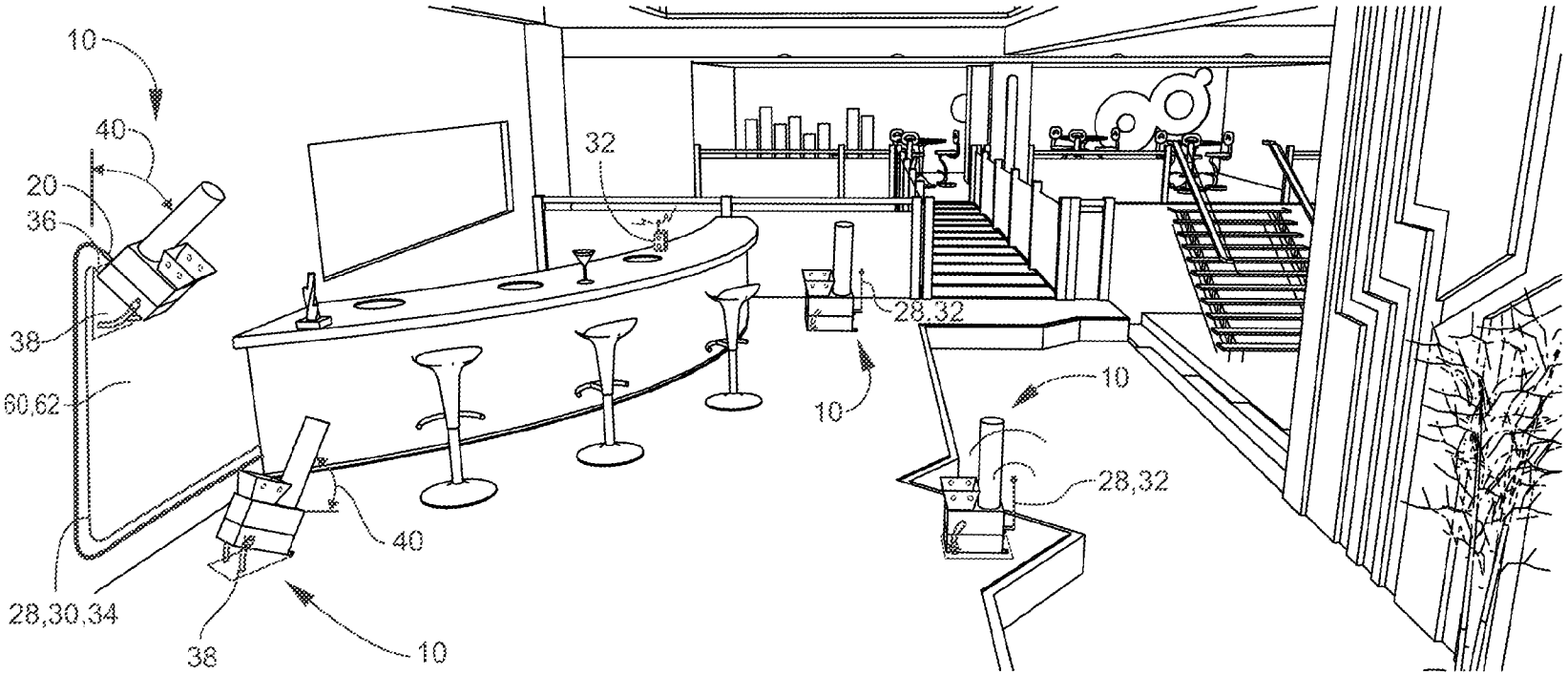
FIG. 8 is an environmental perspective view of multiple embodiments of the confetti cannon devices mounted in various locations and orientations.

Referring to FIG. 3, internal valve 22 may be included in valve housing 18. Internal valve 22 may be for controlling the firing of confetti cannon 10 via pressurized $CO_2$ tank 80 (or $CO_2$ cryo tank 82 for creating fog or smoke). Internal valve 22 may be positioned anywhere inside valve housing 18, including under launch tube 16 in lower portion 84 of valve housing 18.

Internal valve 22 may be electric solenoid valve 24 for controlling the confetti cannon remotely. Electric solenoid valve 24 may be any electrically controlled valve capable of controlling the firing of confetti cannon 10 via pressurized $CO_2$ tank 80 (or $CO_2$ cryo tank 82 for creating fog or smoke). In one embodiment, electric solenoid valve 24 may be normally closed valve 26 that opens when powered. This may allow for remote activation of confetti cannon 10 by sending power to electric solenoid valve 24. Electric solenoid valve 24 may allow for remote firing of the confetti cannon via an activator 28. Activator 28 may be any desired device or activator for signaling to electric solenoid valve 24 to fire confetti cannon 10, including any wired activators 30 and/or wireless activators 32. The wired activators 30 may be any devices for activating internal valve 22 via a wired signal, including, but not limited to, standard DMX controller 34 (like a DMX512 dimmer pack); a power strip; cryo blaster push button systems; a foot switch, the like, or any combinations thereof. Electric solenoid valve 24 may be powered by any desired voltage, including, but not limited to 120 volts or by 240 volts. For powering electric solenoid valve 24, power cord 36 may be provided. Power cord 36 may be connectable to internal valve 22 through one piece housing 12. Power cord 36 may be any power cord, including, but not limited to, an 8 feet long power cord for powering electric solenoid valve 24.

In one embodiment of confetti cannon 10, the firing of the cannon via electric solenoid valve 24 may be controlled by standard DMX controller 34. Standard DMX controller 34 may be any DMX controller, like a DMX512 dimmer pack. DMX controllers may be readily used in the special effects industry, which should allow for easy integration of the remote firing of confetti cannon 10 into standard special effects controls or modules. For example, in this embodiment, electric solenoid valve 24 may allow for remote firing of confetti cannon 10 via activator 28 controlled by a DMX512 dimmer pack to signal the confetti cannon to blast.

Base plate 38 may be included with confetti cannon 10. See FIGS. 1-4, 7, and 8. Base plate 38 may be for positioning launch tube 16 at various launch angles 40 to base plate 38. In addition, base plate 38 may be for securing confetti cannon 10 in various locations or to various objects. See FIG. 8. Base plate 38 may be any size, shape or material base plate for positioning launch tube 16 at various launch angles 40 to base plate 38, and/or for securing confetti cannon 10 in various locations or to various objects. In select embodiments, as shown in FIGS. 1-4, 7, and 8, base plate 38 may have substantially rectangular shape 68 with corners 70, which may be rounded for safety and/or appearance. For stability, base plate 38 may be sized larger than one-piece housing 12. For example, and clearly not limited thereto, in one embodiment base plate 38 may be sized with a width of 10 inches and a length of almost 16 inches, and one-piece housing 12 may have a width of 6 inches and a length of 10 inches.

Base plate 38 may be hingedly connected to one-piece housing 12 for providing various launch angles 40. Base plate 38 may be hingedly connected to one-piece housing 12 by any means. In one embodiment, base plate 38 may include a pair of base tabs 42 and one-piece housing 12 may include corresponding housing tabs 46 for creating the hinged connection between base plate 38 and one-piece housing 12. See FIGS. 1 and 2. Base tabs 42 and the corresponding housing tabs 46 may be any size or shape for creating the hinged connection between base plate 38 and one-piece housing 12. In one embodiment, base tabs 42 may extend vertically from base plate 38 and may each have base tab holes 44 therethrough. In this embodiment, housing tabs 46 may extend horizontally from one-piece housing 12 and may each have housing tab holes 48 therethrough. Each base tab 42 may be hingedly connected to the corresponding housing tab 46. Base tabs 42 and housing tabs 46 may have any desired shape or size for creating the desired launch angles 40 of confetti cannon 10. Base tabs 42 may have semi circle shape 50 and housing tabs 46 may have an extended semi circle shape 52, for creating a plurality of desired launch angles 40 of launch tube 16 relative to base plate 38. The base tabs 42 may be hingedly connected to housing tabs 46 by any means. In one embodiment, bolts 54 may be included for hingedly connecting each of the base tabs 42 to each of the corresponding housing tabs 46. Each bolt 54 may be inserted through the corresponding base tab hole 44 and housing tab hole 48, thereby being operable to secure one-piece housing 12 at various launch angles 40 to base plate 38. For convenience, bolts 54 may include wing nuts 56 for tightening bolts 54 by hand.

Half moon slots 55 may be included on base plate 38. See FIGS. 1, 2, 4A, and 4B. Half moon slots 55 may be for securing confetti cannon 10 and launch tube 16 at the desired launch angle 40. Valve housing 18 may have side bolts 53 for engagement in half moon slots 55. For manual tightening, wing nuts 57 may be includes for securing confetti cannon 10 and launch tube 16 at the desired launch angle 40 by hand. Half moon slots 55 may be provided in any desired length for allowing any desired launch angles 40. In addition, half moon slots 55 may be included on one side of confetti cannon 10, or may be provided on both sides of confetti cannon 10 for added stability.

In one embodiment, base plate 38 may include a plurality of securing base holes 58. Securing base holes 58 may be for securing confetti cannon 10 in any desired location and/or to any desired objects. Securing base holes 58 may be positioned at any desired location or locations on base plate 38 for securing confetti cannon 10. In one embodiment, securing base holes 58 may be positioned approximate to each corner 70 of base plate 38 for securing confetti cannon 10 in the various desired locations or to various desired objects. For example, the securing base holes 58 may allow base plate 38 to be mounted to wall 60 or truss 62. To aid in securing base plate 38 to wall 60 or truss 62, a clamp system may be incorporated, like a standard C or J clamp system.

Valve housing 18 may be included for housing internal valve 22. See FIG. 3. Valve housing 18 may also provide a flow path or communication path from the bottom of confetti hopper 14 to the bottom of launch tube 16. As such, valve housing 18 may be divided into lower portion 84 and upper portion 86 via divider 88. In this embodiment, upper portion 86 may provide the flow path from the bottom of confetti hopper 14 to the bottom of launch tube 16 and lower portion 84 may house internal valve 22. Divider 88 may separate upper portion 86 from lower portion 84, thereby keeping internal valve 22 safely out of the flow path from the bottom of confetti hopper 14 to the bottom of launch tube 16.

Confetti hopper 14 may be included for loading confetti, streamers or the like into confetti cannon 10. Confetti hopper 14 may be any desired shape or size. As an added safety feature, confetti hopper 14 may include at least one hopper hole 72 therethrough. Hopper hole 72 may be for preventing objects from being suctioned to the top of confetti hopper 14. Hopper hole 72 or a plurality of hopper holes 72 may be included anywhere on confetti hopper 14. In one embodiment, as shown in the FIGS. 1, 2 and 6, confetti hopper 14 may include two hopper holes 72 on two opposite sides of confetti hopper 14 for preventing objects from being suctioned to the top of confetti hopper 14.

Launch tube 16 may be included for shooting the confetti, streamers or the like out of confetti cannon 10. Launch tube 16 may be any desired shape or size. For example, and clearly not limited thereto, in one embodiment launch tube 16 may have a 4 inch diameter and be 16 inches tall.

Pipe nipple 74 may be included with confetti cannon 10. See FIGS. 3 and 6. Pipe nipple 74 may be connected to and extend from internal valve 22 into the bottom 76 of launch tube 16 for firing confetti inside launch tube 16 and creating a continuous vacuum or venturi effect from confetti hopper 14 to launch tube 16. Pipe nipple 74 may run from lower portion 84 of valve housing 18 through divider 88, into upper portion 86, and into bottom 76 of launch tube 16. Pipe nipple 74 may be positioned anywhere into bottom 76 of launch tube 16, including, but not limited to, being positioned approximate the perimeter 78 of launch tube 16 farthest from confetti hopper 14. Pipe nipple 74 may be provided in any desire size or shape for creating any desired amount of continuous vacuum or venturi effect from confetti hopper 14 to launch tube 16. In one embodiment, pipe nipple 74 may have a diameter size of approximately ⅜ of an inch. In addition, pipe nipple 74 may extend any desired distance into launch tube 16 for creating the desired amount of continuous vacuum or venturi effect. In one embodiment, pipe nipple 74 may extend approximately 2 inches into bottom 76 of launch tube 16.

Inlet 20 may be operable to connect pressurized $CO_2$ tank 80 to internal valve 22 for firing confetti out of launch tube 16. In addition, inlet 20 may be operable to connect pressurized $CO_2$ cryo tank 82 for creating a fog or smoke out of launch tube 16. As such, confetti cannon 10 may be operable by filling confetti hopper 14 and/or launch tube 16 with confetti, streamers or the like and connecting a pressurized $CO_2$ tank to inlet 20. In addition, in one embodiment confetti cannon 10 may be transformable into a $CO_2$ cryogenic jet or fog machine by connecting a pressurized $CO_2$ cryo tank to inlet 20. Furthermore, in another embodiment confetti cannon 10 may be transformable into a combined confetti cannon and $CO_2$ cryogenic jet or fog machine by filling with confetti and connecting a pressurized $CO_2$ cryo tank to inlet 20.

Figure 9:
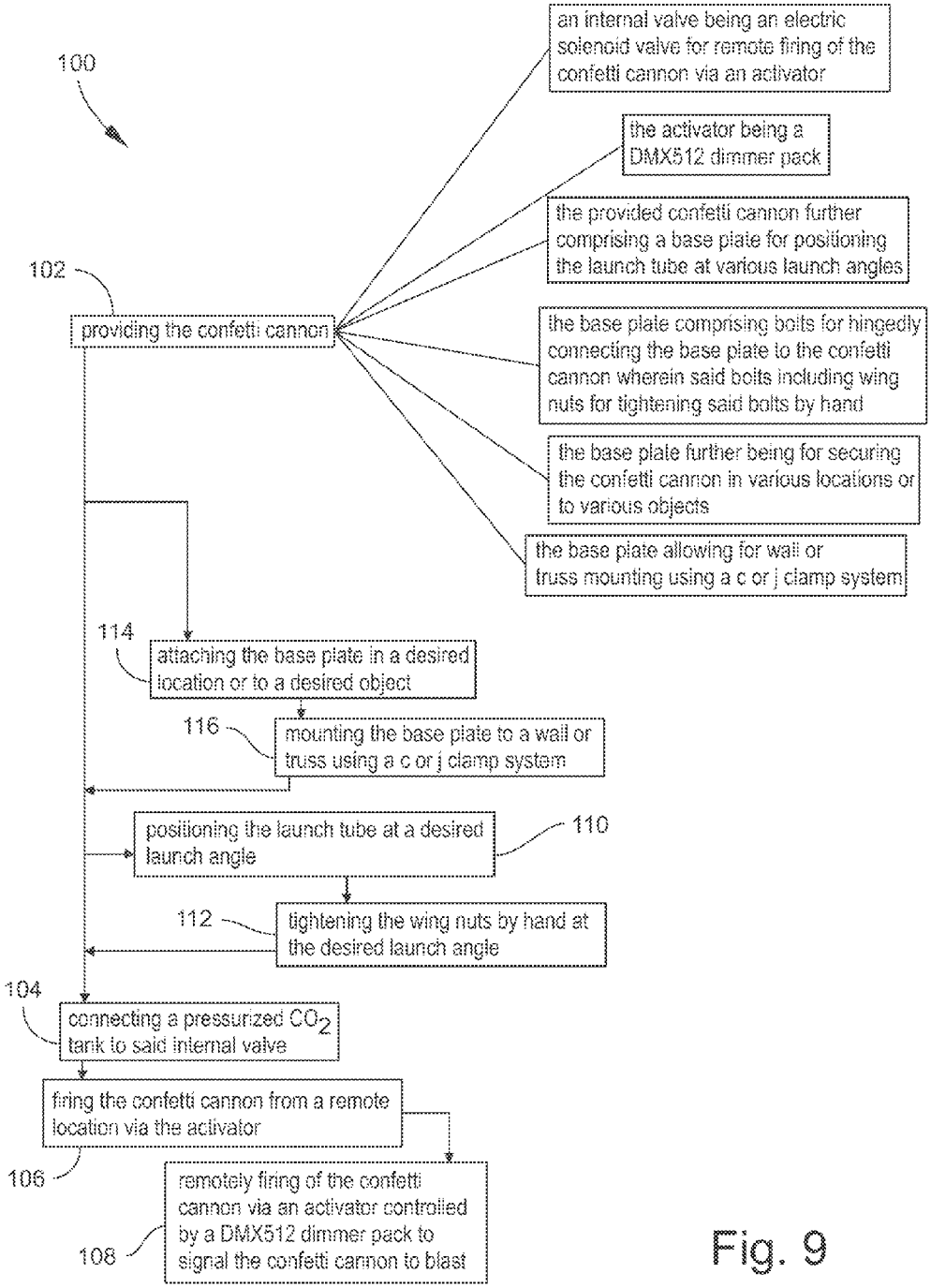
FIG. 9 is a flow chart depicting an exemplary embodiment of the method of remotely launching confetti into the air.

Referring to FIG. 9, in use, method 100 of remotely launching confetti into the air may be accomplished with various embodiments of confetti cannon 10, as shown and described herein. Method 100 of remotely launching confetti into the air may generally include the steps of: a step 102 of providing confetti cannon 10 as shown and described herein with internal valve 22 being electric solenoid valve 24 for remote firing of confetti cannon 10 via activator 28; a step 104 of connecting pressurized $CO_2$ tank 80 (or pressurized $CO_2$ cryo tank 82 for fog machine operation) to internal valve 22; and a step 104 of firing confetti cannon 10 from a remote location via activator 28.

In one embodiment of method 100, when the activator 28 may be standard DMX controller 34, like a DMX512 dimmer pack, the step 106 of firing the confetti cannon 10 from a remote location may include step 108 of remotely firing of the confetti cannon 10 via activator 28 controlled by standard DMX controller 34 to signal confetti cannon 10 to blast.

In another embodiment of method 100, when the provided confetti cannon 10 further includes base plate 38 for positioning launch tube 16 at various launch angles 40, method 100 may further comprise step 110 of positioning launch tube 16 at a desired launch angle 40 via base plate 38. When base plate 38 may include bolts 54 for hingedly connecting base plate 38 to the confetti cannon wherein bolts 54 include wing nuts 56 for tightening bolts 54 by hand, the step 110 of positioning launch tube 16 at a desired launch angle 40 via base plate 38 may include step 112 of tightening wing nuts 56 by hand at the desired launch angle 40.

In another embodiment of method 100, when base plate 38 further may be for securing confetti cannon 10 in various locations or to various objects, method 100 may further include step 114 of attaching base plate 38 in a desired location or to a desired object. In embodiments where base plate 38 may allow for wall 60 or truss 62 mounting like by using a clamp system (i.e. a C or J type clamp system), step 114 of attaching base plate 38 in a desire location or to a desired object may include step 116 of mounting base plate 38 to a wall 60 or truss 62, like by using a clamp system (i.e. a C or J type clamp system).

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A confetti cannon comprising:

a one piece housing comprising:

a confetti hopper;

a launch tube; and a valve housing with an inlet connected to an internal valve, the valve housing divided into a lower portion and an upper portion via a divider, the upper portion providing a flow path from the bottom of the confetti hopper to the bottom of the launch tube and the lower portion housing the internal valve;

whereby, the hopper, the launch tube, and the valve housing being integrally formed to create said one piece housing.

2. The confetti cannon of claim 1 wherein the internal valve being an electric solenoid valve for controlling the confetti cannon remotely, wherein the electric solenoid valve being a normally closed valve that opens when powered allowing for remote firing of the confetti cannon via an activator.

3. The confetti cannon of claim 2 wherein the activator being selected from the group consisting of: wired activators; and wireless activators.

4. The confetti cannon of claim 2 wherein the electric solenoid valve allowing for remote firing of the confetti cannon via an activator controlled by a standard DMX controller to signal the confetti cannon to blast.

5. The confetti cannon of claim 1 further comprising a base plate for positioning the launch tube at various launch angles to said base plate, for securing the confetti cannon in various locations or to various objects, or combinations thereof.

6. The confetti cannon of claim 5 wherein:

said base plate comprising a pair of base tabs vertically extending from said base plate having base tab holes therethrough, and said one piece housing having corresponding housing tabs extending horizontally from the one piece housing having housing tab holes therethrough each being hingedly connected to said corresponding base tab.

7. The confetti cannon of claim 6 further comprising bolts for hingedly connecting each of said base tabs to each of said corresponding housing tabs, whereby, each bolt inserted through said corresponding base tab hole and housing tab hole being operable to secure said one piece housing at said various launch angles to said base plate.

8. The confetti cannon of claim 5 wherein said base plate including at least one half moon slot for securing the confetti cannon and said launch tube at said launch angle, wherein said valve housing having side bolts for engagement in said half moon slots;

and a wing nut being operable to secure the side bolt in the half moon slot at the desired launch angle.

9. The confetti cannon of claim 5 wherein said base plate including a plurality of securing base holes approximate to each corner of said base plate for securing the confetti cannon in the various locations or to various objects, wherein said base plate allowing for wall or truss mounting using a clamp system.

10. The confetti cannon of claim 1 wherein said confetti hopper including at least one hopper hole therethrough for preventing objects from being suctioned to the top of the confetti hopper.

11. The confetti cannon of claim 1 wherein said launch tube including a pipe nipple connected to and extending from said internal valve into the bottom of the launch tube for firing confetti inside said launch tube and creating a continuous vacuum from said confetti hopper to said launch tube.

12. The confetti cannon of claim 11 wherein said inlet being operable to connect a pressurized $CO_2$ tank or a pressurized $CO_2$ cryo tank to said internal valve and said pipe nipple, whereby:

the confetti cannon being operable by filling with confetti and connecting said pressurized $CO_2$ tank, being transformable into a $CO_2$ cryogenic jet or fog machine by connecting said pressurized $CO_2$ cryo tank to said inlet, or being transformable into a combined confetti cannon and $CO_2$ cryogenic jet or fog machine by filling with confetti and connecting said pressurized $CO_2$ cryo tank to said inlet.

13. A confetti cannon comprising:

an internal electric solenoid valve for controlling the confetti cannon remotely, the electric solenoid valve being a normally closed valve that opens when powered allowing for remote firing of the confetti cannon via an activator: and a valve housing divided into a lower portion and an upper portion via a divider, the upper portion providing a flow path from a bottom of a confetti hopper to a bottom of a launch tube and the lower portion housing the internal electric solenoid valve.

14. The confetti cannon of claim 13 wherein the activator being selected from the group consisting of: wired activators; and wireless activators.

15. The confetti cannon of claim 13 wherein the electric solenoid valve allowing for remote firing of the confetti cannon via an activator controlled by a standard DMX controller to signal the confetti cannon to blast.

16. The confetti cannon of claim 13 further comprising a valve housing with an inlet connected to said internal valve.

17. A method of remotely launching confetti into the air comprising the steps of:

providing a confetti cannon comprising:

an internal electric solenoid valve for remote firing of the confetti cannon via an activator; and a valve housing divided into a lower portion and an upper portion via a divider, the upper portion providing a flow path from a bottom of a confetti hopper to a bottom of a launch tube and the lower portion housing the internal electric solenoid valve connecting a pressurized $CO_2$ tank to said internal valve; and firing the confetti cannon from a remote location via the activator.

18. The method of remotely launching confetti into the air of claim 17 wherein the activator being a standard DMX controller, whereby, the step of firing the confetti cannon from a remote location including a step of remotely firing of the confetti cannon via an activator controlled by said standard DMX controller to signal the confetti cannon to blast.

19. The method of remotely launching confetti into the air of claim 17 wherein:

said provided confetti cannon further comprising a base plate for positioning a launch tube at various launch angles, whereby the method further comprising the step of positioning the launch tube at a desired launch angle via the base plate;

said base plate comprising bolts for hingedly connecting the base plate to the confetti cannon wherein said bolts including wing nuts for tightening said bolts by hand, whereby the step of positioning the launch tube at a desired launch angle via the base plate including the step of tightening the wing nuts by hand at the desired launch angle;

said base plate further being for securing the confetti cannon in various locations or to various objects, whereby the method further comprising the step of attaching the base plate in a desired location or to a desired object;

said base plate allowing for wall or truss mounting using a standard clamp system, the step of attaching the base plate in a desire location or to a desired object including the step of mounting the base plate to a wall or truss using said standard clamp system; or combinations thereof.

* * * * *